US006250516B1

(12) United States Patent
Story et al.

(10) Patent No.: US 6,250,516 B1
(45) Date of Patent: Jun. 26, 2001

(54) ASSEMBLY FOR FILLING CANISTERS

(75) Inventors: Edward Ross Story, Fairfield, CT (US); David Joseph Clark, Middletown, NY (US)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 0 days.

(21) Appl. No.: 09/286,025

(22) Filed: Apr. 5, 1999

(51) Int. Cl.[7] ..... B67D 3/00

(52) U.S. Cl. ..... 222/559; 222/561; 222/563; 251/339; 251/358

(58) Field of Search ..... 222/559, 561, 222/563; 251/339, 324, 356, 358, 368

(56) References Cited

U.S. PATENT DOCUMENTS

| | | | | |
|---|---|---|---|---|
| 4,196,886 | | 4/1980 | Murray . | |
| 4,363,429 | | 12/1982 | Schindler . | |
| 4,372,467 | * | 2/1983 | Pritchitt | 222/501 |
| 4,525,910 | * | 7/1985 | Boehmer | 29/156.7 R |
| 4,537,335 | | 8/1985 | Rangwala et al. . | |
| 5,016,687 | | 5/1991 | Kawamura . | |
| 5,097,993 | * | 3/1992 | Davis | 222/559 X |
| 5,137,187 | | 8/1992 | Nichols et al. . | |
| 5,183,075 | | 2/1993 | Stein . | |
| 5,727,776 | * | 3/1998 | Gerstenberger | 251/368 |
| 5,822,958 | * | 10/1998 | Davis | 222/559 X |

* cited by examiner

*Primary Examiner*—Joseph A. Kaufman
*Assistant Examiner*—David Deal
(74) *Attorney, Agent, or Firm*—Matthew Boxer

(57) ABSTRACT

A device for controlling fluid or liquid flow which comprises:

a.) a metallic fill tube which is tapered at one end and has an opening at said end and has an internal profile and an outer profile;

b.) a metallic tip and elastomeric assembly within said metallic fill tube; and which forms a seal with the internal profile of said fill tube upon contact with said internal profile;

c.) a nozzle which at one end is attached to said metallic tip; and wherein the opening of said metallic fill tube has approximately the same radius as the metallic tip and elastomeric assembly, is described.

12 Claims, 1 Drawing Sheet

ASSEMBLY FOR FILLING CANISTERS

BACKGROUND OF THE INVENTION

Presently, the filling of canisters with fluids, and especially the filling of antiperspirant/deodorant canisters with liquids, is done by metal to metal seals. While such filling enables volumetric filling, the system requires high sealing pressure and usually begins to leak after a few days of use, especially when the antiperspirant deodorant material contains a high proportion of solids.

More specifically, antiperspirant/deodorant liquids are today being filled into canisters through a metal tube or filling tube with an internal metal tip or plunger that seals to the inside of the tube. Such a filling method has the following disadvantages:

1) It is prone to splashing during the fill cycle.
2) High pressures (for example 60 psi) are required to seal the plunger; and
3) Dripping after filling often occurs and this is caused by wear in the metal to metal sealing mechanism due to the high proportion of solids in the fluid or liquid being filled.

The present invention relates to a device for controlling fluid or liquid flow into canisters, which eliminates the above-mentioned disadvantages of filling.

The following list of patents relates to known devices for controlling fluid or liquid flow.

The following is a list of U.S. Patents in this area of technology.

U.S. Pat. No. 5,016,867;

U.S. Pat. No. 4,363,429;

U.S. Pat. No. 5,537,335;

U.S. Pat. No. 5,183,075;

U.S. Pat. No. 5,137,187; and

U.S. Pat. No. 4,196,886.

SUMMARY OF THE INVENTION

The present invention relates to a device for filling canisters with fluids or liquids which comprises a metallic tip of a fill tube and an elastomeric dome assembly which is manipulated within that tip. While the elastomeric dome assembly is positioned above the metallic tip of the fill tube, fluid or liquid, flows from a nozzle, through the space between the elastomeric dome assembly and the metallic tip of the filling tube, filling the canister below. When the elastomeric dome assembly contacts the internal profile of the fill tube, it forms a seal, and thus stops the filling of fluid or liquid into the canister.

A low durometer elastomer capable of operating at high temperatures is used for the dome thereby reducing the pressure required to form a seal. When the elastomeric dome assembly contacts the internal profile of the fill tube the elastomer is deformed to accommodate the solid particles. Thus, wear is reduced and the integrity of the seal is maintained.

The invention also relates to a method for filling canisters with fluid or liquid which comprises using the device of the invention.

DETAILED DESCRIPTION OF THE INVENTION

Figure 1:
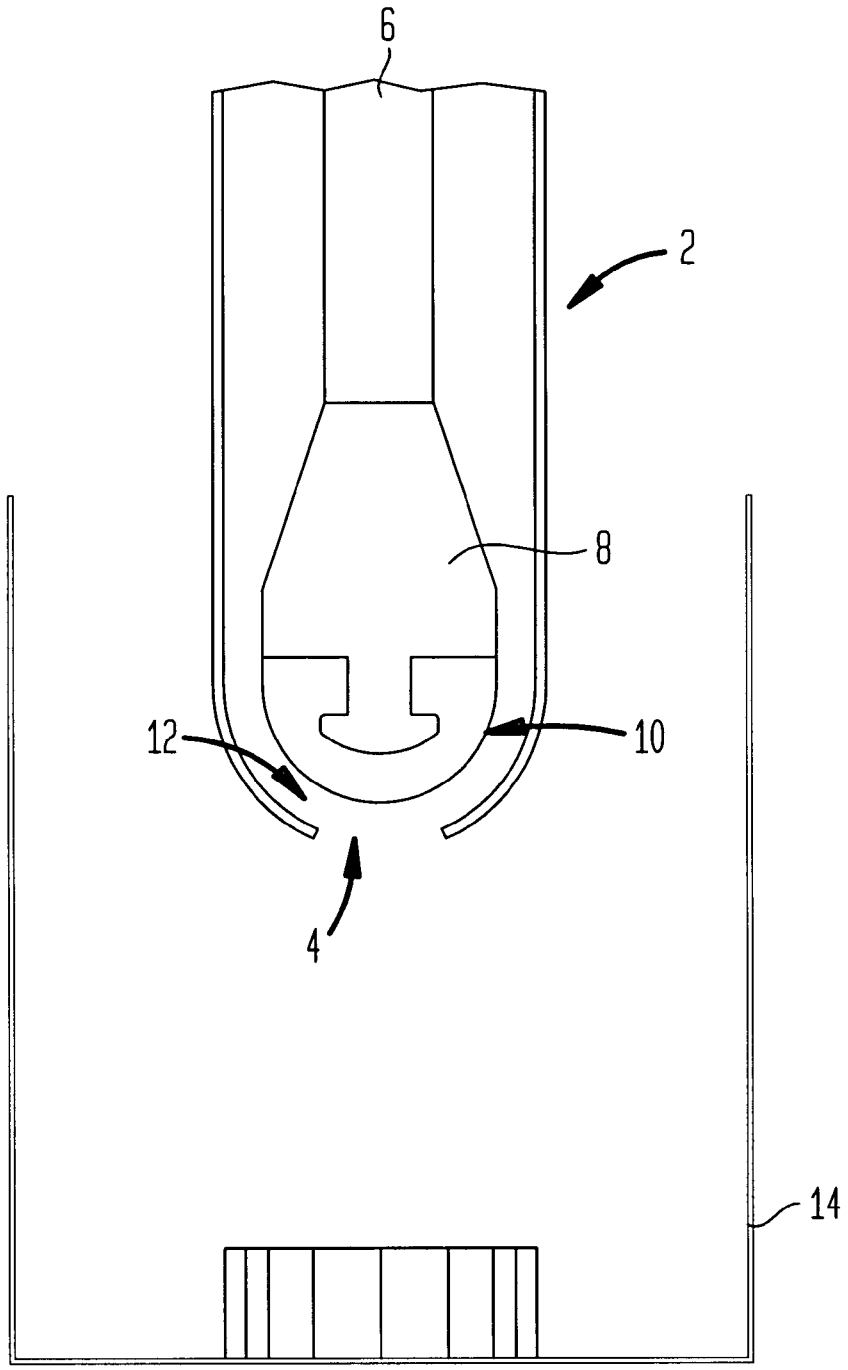
FIG. 1 illustrates a cross-sectional view of an embodiment of the invention wherein an elastomeric dome assembly is shown inside a fill tube.

The present invention uses an elastomeric dome assembly within the metallic tip of a fill tube. The dome is a hemisphere in its shape. The dome could also be any shape which is similar to a hemisphere or any other type of mound or protuberance. The dome could be egg-shaped or the shape made by an ellipse which has been rotated about its long axis. Indeed, the dome could be any convex shape (the nozzle within the dome can be concave). Instead of being dome-shaped, the elastomeric portion of the present invention can also be cone-shaped or pointed in shape. The dome could be partly hemispheric and partly flat. It will be understood that when the elastomeric dome assembly is discussed in this specification, that these other dome-like shapes are also being included within this term. It will also be understood, that when the invention is being described, that the elastomeric portion can also be cone-shaped or pointed in shape or other shapes which are not domes. Finally, it should be understood the O-rings are not being contemplated by the present invention.

When the elastomeric dome assembly is separated from the internal profile of the fill tube, fluid or liquids flows through the space between the elastomeric dome assembly and the internal profile of the fill tube, to fill the canister. When the elastomeric dome assembly contacts or mates with the internal profile of the fill tube, it forms a seal, thereby stopping the flow of fluid or liquid into the canister. The forming of a seal is done via a transfer mold process. A mold transfer process is a method by which a part cured polymeric matrix is formed into the desired shape at high temperature and pressure. The pre-cured elastomer is extruded through ports under pressure to fill cavities that have been machined to the desired shape, (in this case dome). In each cavity a metal tip is placed prior to the extrusion, allowing the elastomer to be attached to the tip.

In the assembly of the invention, it is important that the elastomeric tip be spherical or in the shape of a dome. A dome provides a larger surface area than for example an O-ring. With a larger surface are, less force can be used to form a seal. Therefore, less force is needed to operate the machinery for filling canisters and there is less wear and tear on the machinery. A dome, by providing a larger surface than say an O-ring, also affords a greater contact area between the metal and the elastomer and thus allows for a better seal. By providing a larger surface than say an O-ring, a dome better protects metal from erosion.

A low durometer elastomer capable of operating at high temperatures is used for the dome thereby reducing the pressure required to form a seal. By elastomer is meant a macromolecular material that returns to its initial dimensions after it has been deformed by a stress and the stress has been removed. By low durometer elastomer is meant a macromolecular elastomer that has a low hardness or resistance to deformation or indentation by a blunt indenter. Typically, the hardnesses used in this invention are in the Shore A range of durometer.

As used herein, an elastomeric dome assembly means a metallic rod, one end of which is fitted or covered with a low durometer elastomeric dome. An elastomeric dome assembly is made as follows: the end of a metallic rod is machined to retain an elastomeric dome. Elastomeric material, compression molded to the shape of a dome, is bonded or attached to the metallic rod.

Maximum adherence of the elastomeric dome to the internal profile of the metallic tip surrounding it, reduces the fatigue the dome is subjected to during the sealing process, and thereby extends the life of the device of the invention.

An embodiment of a device is described in more detail, making reference to FIG. 1.

In FIG. 1, fill tube 2 has an opening 4 at its lower end. Within fill tube 2, is a nozzle 6, and a nozzle tip 8. Attached to the lower end of nozzle tip 8 is an elastomeric dome 10.

A fluid or liquid (especially a solid containing antiperspirant/deodorant liquid) is filled through opening 4 into canister 14 below through the space 12 between the nozzle and the internal profile of the fill tube. The filling may either be into the top or the bottom of the canister depending on the product. Because antiperspirant/deodorant is typically solid at room temperature, the filling is done at higher temperature, for example from about 100° F. to about 190° F. depending upon the product. As noted above, while elastomeric dome 10 is positioned above opening 4, fluid or liquid flows through space 12 and opening 4 into canister 14. While elastomeric dome 10 is in contact with the internal profile of the fill tube (that is, while the elastomeric dome assembly is mated to the internal profile of the fill tube) no fluid or liquid flows to the canister.

The elastomeric dome is typically spherical or oval in shape. The internal orifice at the tip of the fill tube is machined to the same radius as that of the tip of the dome. More specifically, the radius of the internal orifice at the tip of the fill tube is within about +/−0.005 inch of the radius of the tip of the dome.

The size of the orifice is determined by the clearance between the elastomeric dome and the inside diameter of the fill tube. The size of the orifice is determined so as to maximize the contact area and hence the sealing performance. Moreover, the fact that the radii of the internal profile of the fill tube and the elastomeric dome are substantially the same, induces laminar flow of fluid or liquid and reduces splashing.

As noted above, antiperspirant/deodorant products often have high solid content and hence are very abrasive. Thus, the elastomer used must be tear and abrasion resistant, and must also be able to withstand the temperatures employed, and must also be chemically resistant to the product (and all of its components) being filled.

By using a compliant nozzle, with an elastomeric dome, instead of a rigid nozzle, the solids in the liquid stream being used for filling are not compressed between two metal surfaces as is the case in the prior art metal-metal systems. Instead, in the present invention, the solids in the liquid stream are pressed between metal (of the internal profile of the fill tube) and a softer material (the elastomer of the dome assembly). The softer material deforms to the shape of the solid particles. As a result, the life of the nozzle is increased as the metal part of the nozzle is subjected to reduced wear. (The nozzle is part 2 of FIG. 1.)

The hardness of the elastomer that can be used in devices of the invention, is a function of the desired pressure of filling. This can be shown by the following equations:

$$\text{Surface area of the nozzle sphere} = \tfrac{1}{2}(4\pi r^2)$$

$$\text{Contact area} = \tfrac{1}{2}(4\pi r^2) - H$$

where r is the radius of the dome and H is the spherical area of the orifice.

Assuming constant pressure across the contact area, the force (F) applied is a function of the nozzle sealing pressure and the dome contact area according to the following equation:

$$F = P\,(\tfrac{1}{2}(4\pi r^2) - H)$$

Assuming the solids in the antiperspirant/deodorant liquids are spherical particles with a radius R, the Hertz equation for ball indentation into an elastomeric body can be employed.

$$\text{Hertz equation: } E_{mod} = (\tfrac{3}{4}(F/X^{1/5}))\,.\,(1/\sqrt{R})\,(1-\mu^2)$$

Wherein $E_{mod}$ is the modulus of the elastic body, X is the displacement of the spherical particle (equation is non-linear after ball Is intended past half way and $\mu$ is the Poissons ratio of the elastomeric body.

Therefore, the modulus or hardness of the sealing dome is given by $$E_{mod} = (\tfrac{3}{4}(P\{\tfrac{1}{2}(4\pi r^2) - H\}/X^{1/5}))\,.\,(1/\sqrt{R})\,(1-\mu^2)$$

Accordingly, $X^{1/5}$ is proportional to $1/E_{mod}$ and $X^{1/5}$ is proportional to 1/R hence as the Modulus of the elastomer and the Radius of the particle are increased, the indentation depth of the particle is decreased. Using the modified Hertz equation it was determined that a low modulus coating corresponding to a hardness of around 40 Shore A could be used with sealing pressure between about 5 and about 20 psi when the formulation of a known commercial antiperspirant/deodorant was used in the filling process.

When the elastomeric "dome" assembly is other than hemispheric, the above equations can be used to calculate the hardness of the elastomer except that the equation for the shape of this other dome must be used in place of the equations which apply for a hemisphere. One skilled in the art will know how to make these mathematical substitutions.

Examples of elastomers which may be used in devices of the invention are Natural rubbers, synthetic rubbers, polyurethanes, silicones or thermoplastic elastomers; more specifically, fluorinated cross-linkable rubbers or fluoroelastomers. Fluoroelastomers are a family of elastomers designed for higher temperature use. In particular, a fluoroelastomer made from vinylidene fluoride and hexafluoropropylene monomers (Viton A) can be used, Viton 1 the fluoroelastomer of Viton A family and an FKM elastomer, can be used. Viton 2, the fluoroelastomer of the Viton A family plus inert filler, can also be used. HNBR hydrogenated acrylonitrile rubber and polyurethanes can also be used. Other more resistant fluorinated elastomer systems such as perfluoroelastomers can also be used. The elastomer to be used may be varied depending upon the temperature of the sealing operation, the strength of the elastomer desired, and the chemical resistance required for the elastomer. Taking this into consideration, one skilled in the art would be able to select the correct elastomeric material to be used given the particular sealing operation to be carried out.

Pressures during the filing step can range from about 1 to about 50 psi. About 5 psi is the preferred pressure, using Viton 1 as the elastomer.

Elastomeric hardness, of the elastomer to be employed, can be selected by using the above equations which relate desired filling pressure, the elastomeric and the particle size hardness. Elastomeric hardness other than those calculated from the above equations can also be used in elastomers in devices of the invention.

The invention also relates to a method for filling canisters with a fluid or liquid by using a device described above.

An embodiment of the invention describing the use of a filling device or nozzle in conjunction with the canisters to be filled, is described just below The canister is positioned underneath the nozzle and the nozzle is lowered in to the canister. The tip retracts inside the nozzle tube, opening the orifice, allowing the filling to begin.

At completion of the filling cycle, the internal rod and tip is extended, closing the orifice and sealing against the inside of the tube. The nozzle is retracted from the canister, removed and a new empty canister is positioned beneath the nozzle and the process is repeated.

What is claimed:

1. A device for controlling fluid flow which comprises:

(a) a metallic fill tube which is tapered and has an opening at one end and has an inner profile at said end and an outer profile at said end;

(b) a metallic tip and elastomeric dome assembly within said metallic fill tube, which forms a seal upon contact of said metallic tip and elastomeric dome assembly with said internal profile at said tapered end of the fill tube;

(c) a nozzle which at one end is attached to said metallic tip of the metallic tip and dome assembly;

and wherein the metallic fill tube opening has a radius within about +/−0.005 inch of the radius of the tip of the dome.

2. A device in accordance with claim 1, wherein said device is suitable for filling to be done at approximately 190° F.

3. A method for filling canisters with a fluid or liquid which comprises directing said fluid or liquid through a device according to claim 1.

4. A method according to claim 3 for filling canisters with a fluid or liquid which comprises sealing the fluid or liquid at a pressure of about 1 to about 50 psi.

5. A method according to claim 4 wherein the fluid or liquid is sealed at a pressure of about 5 psi.

6. A method according to claim 4 wherein said fluid or liquid is an antiperspirant/deodorant.

7. A method according to claim 6 wherein said antiperspirant/deodorant has a high solid content.

8. A method according to claim 4 which is carried out at a temperature between about 100° F. to about 190° F.

9. A method according to claim 3 wherein said elastomeric dome assembly is a hemisphere and the hardness of said elastomer, $E_{dome}$ is related to the pressure of the filling stroke P, by the following equation:

$$E_{dome}=\{\tfrac{3}{4}(P/\{\tfrac{1}{2}(4\pi r^2)-H\}/X^{1/5})\}/\sqrt{R}\}X(1-\mu^2)$$

wherein

R is the radius of the metallic tip and elastomeric dome assembly;

X is the displacement of the stroke; and $\mu$ is the Poisson ratio.

10. A method according to claim 3 wherein the hardness of the elastomer is about 40 Shore A.

11. A device according to claim 1 wherein the hardness of said elastomer of sealing dome ($E_{dome}$) is given by $$E_{dome}=(\tfrac{3}{4}(P\{\tfrac{1}{2}(4\pi r^2)-H\}/X^{1/5})\}/\sqrt{R}\}X\ (1-\mu^2)$$

wherein H is the spherical area of said orifice;

R is the radius of said dome;

P is the pressure of the filling stroke;

X is the displacement of the spherical particle;

$\mu$ is the Poisson ratio; and $E_{dome}$ is the modulus or hardness of the sealing dome.

12. A device according to claim 1, wherein the hardness of said elastomer of the elastomeric dome assembly is about 40 Shore A.

* * * * *